US010088158B2

(12) United States Patent
Rahbar

(10) Patent No.: US 10,088,158 B2
(45) Date of Patent: Oct. 2, 2018

(54) RETRACTABLE DIRECTIONAL FLAME NOZZLE FOR LIGHTER

(71) Applicant: Daniel Rahbar, Pacific Palisades, CA (US)

(72) Inventor: Daniel Rahbar, Pacific Palisades, CA (US)

( * ) Notice: Subject to any disclaimer, the term of this patent is extended or adjusted under 35 U.S.C. 154(b) by 514 days.

(21) Appl. No.: 14/676,721

(22) Filed: Apr. 1, 2015

(65) Prior Publication Data

US 2016/0018108 A1 Jan. 21, 2016

Related U.S. Application Data

(60) Provisional application No. 62/024,663, filed on Jul. 15, 2014.

(51) Int. Cl.

| | |
|---|---|
| ***F23Q 2/34*** | (2006.01) |
| ***F23Q 2/167*** | (2006.01) |
| *F23Q 2/50* | (2006.01) |

(52) U.S. Cl.

CPC ..... *F23Q 2/167* (2013.01); *F23Q 2/34* (2013.01); *F23Q 2/50* (2013.01)

(58) Field of Classification Search

CPC ..... F23Q 2/00; F23Q 2/34; F23Q 2/50; F23D 14/48

USPC ..... 431/131, 255, 153, 144, 126

See application file for complete search history.

(56) References Cited

U.S. PATENT DOCUMENTS

| | | | |
|---|---|---|---|
| 3,245,234 | A | 4/1966 | Kanamaru |
| 3,309,902 | A | 3/1967 | Kanamaru |
| 3,663,152 | A | 5/1972 | Yoshida |
| 3,695,819 | A | 10/1972 | Tricot |
| 3,844,707 | A | 10/1974 | Wormser |
| 3,884,616 | A | 5/1975 | Neyret |
| 3,915,623 | A | 10/1975 | Wormser |
| D245,269 | S | 8/1977 | Yoshinaga |
| D245,345 | S | 8/1977 | Nitta |
| D245,346 | S | 8/1977 | Yoshinaga |
| D250,899 | S | 1/1979 | Beleckis |
| D251,922 | S | 5/1979 | Yoshinaga |
| 4,259,059 | A | 3/1981 | Roosa |

(Continued)

FOREIGN PATENT DOCUMENTS

AU 2012201124 A1 * 9/2012 ..... F23Q 2/34

OTHER PUBLICATIONS

Brown A from Australia, Cigarett Lighter, Sep. 2012, English machine Translation, all pages.*

*Primary Examiner* — Gregory Huson
*Assistant Examiner* — Nikhil Mashruwala
(74) *Attorney, Agent, or Firm* — Michael N. Cohen; Cohen IP Law Group PC

(57) ABSTRACT

A portable lighter device adaptable to move in a plurality of extended positions, in a plurality of angular positions and in a retracted position. The portable lighter device comprises a shield member having a flame directing nozzle, a housing, a first shield slot, a second shield slot, a left lug and a right lug. A sliding movement of the left lug and the right lug enables the flame directing nozzle to move in the plurality of extended positions and in the retracted position. At least one groove of the shield member comfortably accommodates the flame directing nozzle within the housing while the nozzle is tilted in at least one of the plurality of angular positions according to the user's comfort.

20 Claims, 10 Drawing Sheets

(56) References Cited

U.S. PATENT DOCUMENTS

| | | | | | |
|---|---|---|---|---|---|
| 4,315,731 | A | | 2/1982 | Moore | |
| 4,640,679 | A | | 2/1987 | Perrin | |
| 4,680,007 | A | | 7/1987 | Schachter | |
| D296,246 | S | | 6/1988 | Eun | |
| 4,784,602 | A | | 11/1988 | Nitta | |
| 4,846,667 | A | | 7/1989 | Lin | |
| 4,859,172 | A | * | 8/1989 | Nitta | F23Q 2/164 431/153 |
| D305,462 | S | | 1/1990 | Nitta | |
| D310,427 | S | | 9/1990 | Nitta | |
| D314,837 | S | | 2/1991 | Nitta | |
| 5,044,933 | A | | 9/1991 | Yang | |
| 5,055,034 | A | | 10/1991 | Wang | |
| 5,125,829 | A | | 6/1992 | McDonough | |
| 5,135,388 | A | | 8/1992 | Pettit | |
| 5,387,101 | A | | 2/1995 | Chan | |
| 5,421,720 | A | | 6/1995 | Sher | |
| 5,445,518 | A | | 8/1995 | McDonough | |
| 5,462,432 | A | | 10/1995 | Kim | |
| 5,636,979 | A | | 6/1997 | McDonough | |
| 5,704,776 | A | * | 1/1998 | Sher | F23Q 2/164 431/153 |
| 5,735,294 | A | | 4/1998 | McDonough | |
| 5,839,892 | A | | 11/1998 | Hwang | |
| 5,897,307 | A | * | 4/1999 | Chang | F23Q 2/164 431/153 |
| 6,099,300 | A | | 8/2000 | Rice | |
| 6,146,129 | A | | 11/2000 | Li | |
| 6,444,953 | B1 | | 9/2002 | Leishman | |
| 6,461,146 | B1 | | 10/2002 | Hu | |
| 6,533,575 | B2 | | 3/2003 | Man | |
| 6,558,156 | B2 | | 5/2003 | Wong | |
| 6,648,630 | B2 | * | 11/2003 | Tse | F23Q 2/163 431/153 |
| D518,229 | S | * | 3/2006 | Sher | D27/161 |
| D530,855 | S | | 10/2006 | Ruan | |
| 7,387,510 | B2 | * | 6/2008 | Luo | F23Q 2/163 431/255 |
| 7,637,736 | B1 | * | 12/2009 | Yang | F23Q 2/163 431/131 |
| 8,241,033 | B2 | | 8/2012 | Shimizu | |
| 2002/0055077 | A1 | | 5/2002 | Adams | |
| 2004/0234913 | A1 | | 11/2004 | Wong | |
| 2006/0024631 | A1 | | 2/2006 | Wong | |
| 2006/0073431 | A1 | | 4/2006 | Brown | |
| 2006/0073432 | A1 | | 4/2006 | Frigiere | |
| 2008/0044784 | A1 | | 2/2008 | Park | |
| 2014/0120481 | A1 | | 5/2014 | Buchbinder | |

* cited by examiner

RETRACTABLE DIRECTIONAL FLAME NOZZLE FOR LIGHTER

CROSS-REFERENCE TO RELATED APPLICATIONS

The present application claims priority from the U.S. provisional application with Ser. No. 62/024,663, which was filed on Jul. 15, 2014. The disclosure of the provisional application is incorporated herein as if set out in full.

STATEMENT REGARDING FEDERALLY SPONSORED RESEARCH AND DEVELOPMENT

Not Applicable.

FIELD OF THE DISCLOSURE

The present embodiment relates generally to cigarette lighters, and more particularly, to a portable lighter device having a retractable flame directional nozzle and at least one groove that allows the flame directional nozzle to move in different angular positions for diverting the direction of flame according to a user's comfort.

DISCUSSION OF RELATED ART

A wide variety of lighters have been developed in the art. Usually, a conventional lighter is positioned below an item to be lit, so as to take advantage of the natural properties of the flame. However, when the item to be lit is located in a position that is difficult to access and if the item is below the flame, it can sometimes be particularly difficult, and even potentially dangerous when attempting to ignite the item.

The above-mentioned problem exists when the lighter is used to light a candle of the type that includes a wick extending from the top of the candle body. It is not possible to light such candles from below, but rather the lighter must be angled away from the vertical, possibly even as far as horizontal to light the wick. However, the flame still naturally tends to extend upwards in the vicinity of the hand of the user holding the lighter. This adds to the difficulty of lighting the candle and in some instances, can cause injury to the user.

In order to light an item like a pipe, the flame must extend substantially horizontally, or perhaps even in a direction below the horizontal. When a conventional lighter is used for this purpose, there is a great chance of getting burnt.

Yet another conventional lighter includes a flame directing nozzle that is pivotable through substantially an inclination of 90 degrees to direct the flame in a variety of angles. However, as the nozzle permanently projects beyond the body of the lighter and is movable, it significantly alters the shape of the lighter and reduces the portability of the lighter. As such, the projecting nozzle may catch on clothing when carried in pockets or the like, which may damage the flame directing means and the user's clothing as well as be a source of frustration to the user.

A major issue with the conventional lighter is that, when people extend the nozzle and light it, the nozzle itself gets hot very quickly. So, there is a great chance for the user to get burnt while bringing the nozzle back from the extended position to the retracted position. This is because user's thumbs need to come in contact with the nozzle to physically move it back to the retracted state. Moreover, most of the conventional lighter devices do not possess any mechanism that allows the nozzle to move in different orientations according to the user's comfort, nozzle and that prevents the nozzle from moving out of the lighter device. Further, the conventional lighters have a slow rate of heat loss.

Therefore, there is a need for a lighter device that could be used relatively safely in a number of orientations. Such a needed device would be portable. Further, the needed device would be adaptable to move in a number of extended positions. In addition, the lighter device would be retractable to a resting position while not in use. Moreover, such a device would provide a nozzle that stays locked into place, is durable, and prevents injury to the user. Such a needed device would have the facility to cool the heat generated at the nozzle. The present disclosure accomplishes these objectives.

SUMMARY OF THE DISCLOSURE

The present embodiment is a portable lighter device movable in a plurality of extended and angular positions and in a retracted position. The portable lighter device comprises a main body having a first portion and a second portion. The first portion includes a pair of arm members having a first arm slot and a second arm slot. The portable lighter device further comprises a shield member having a housing, a central recess, a first shield slot and a second shield slot. The shield member is designed to shield the pair of arm members. The first shield slot overlaps with the first arm slot to create a first slot assembly and the second shield slot overlaps with the second arm slot to create a second slot assembly. The portable lighter device further comprises a flame directing nozzle having a base member. In the preferred embodiment, the flame directing nozzle is cylindrical shaped and the base member is circular shaped. The housing firmly secures the flame directing nozzle within the central recess of the shield member. The base member is attached to a guide member having a left lug and a right lug. The left lug and the right lug are positioned opposite to each other. The left lug and the right lug are designed to slide through the first slot assembly and the second slot assembly respectively. The user can easily slide the left lug and the right lug up and down with his thumb. The sliding movement of the left lug and the right lug enables the flame directing nozzle to move in the plurality of extended positions and in the retracted position. When the portable lighter device is in the extended position, the flame directing nozzle can be tilted to the plurality of angular positions according the user's comfort.

The at least one groove includes a first set of grooves, a second set of grooves and a third set of grooves. The first set of grooves helps to accommodate the nozzle within the housing while tilting in a zero degree inclination. The at least one of the plurality of first projections and the second projections enable the nozzle to remain at this upright position without pivoting out of the central recess. The second set of grooves helps to comfortably accommodate the nozzle in the housing in a 45 degree inclination. In order to attain a 90 degree inclination, the user tilts the nozzle to 90 degree with his thumb. The third set of grooves helps to accommodate the nozzle within the housing while tilting towards 90 degree inclination. The at least one groove provides a frictional force to the housing that allows the flame directing nozzle to stay locked down while moving in the plurality of angular positions.

The first arm slot includes a plurality of first projections and the second arm slot includes a plurality of second projections. The user can extend the nozzle by sliding the left lug and the right lug in the upward direction. Once the desired height is attained, the user can remove his thumb from the left and the right lug. The plurality of first projections and the plurality of second projections firmly hold the first lug and the second lug without falling down. The plurality of angular positions allows the user to divert the direction of the flame well away from the user's thumb and fingers. The housing prevents the flame directing nozzle from pivoting out of the retractable position, as well as all the plurality of positions, and makes the portable lighter device durable and functional.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

The following describes example embodiments in which the present invention may be practiced. This invention, however, may be embodied in many different ways, and the description provided herein should not be construed as limiting in any way.

In this document, the terms "a" or "an" are used, as is common in patent documents, to include one or more than one. In this document, the term "or" is used to refer to a nonexclusive "or," such that "A or B" includes "A but not B," "B but not A," and "A and B," unless otherwise indicated. Furthermore, all publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

Figure 1:
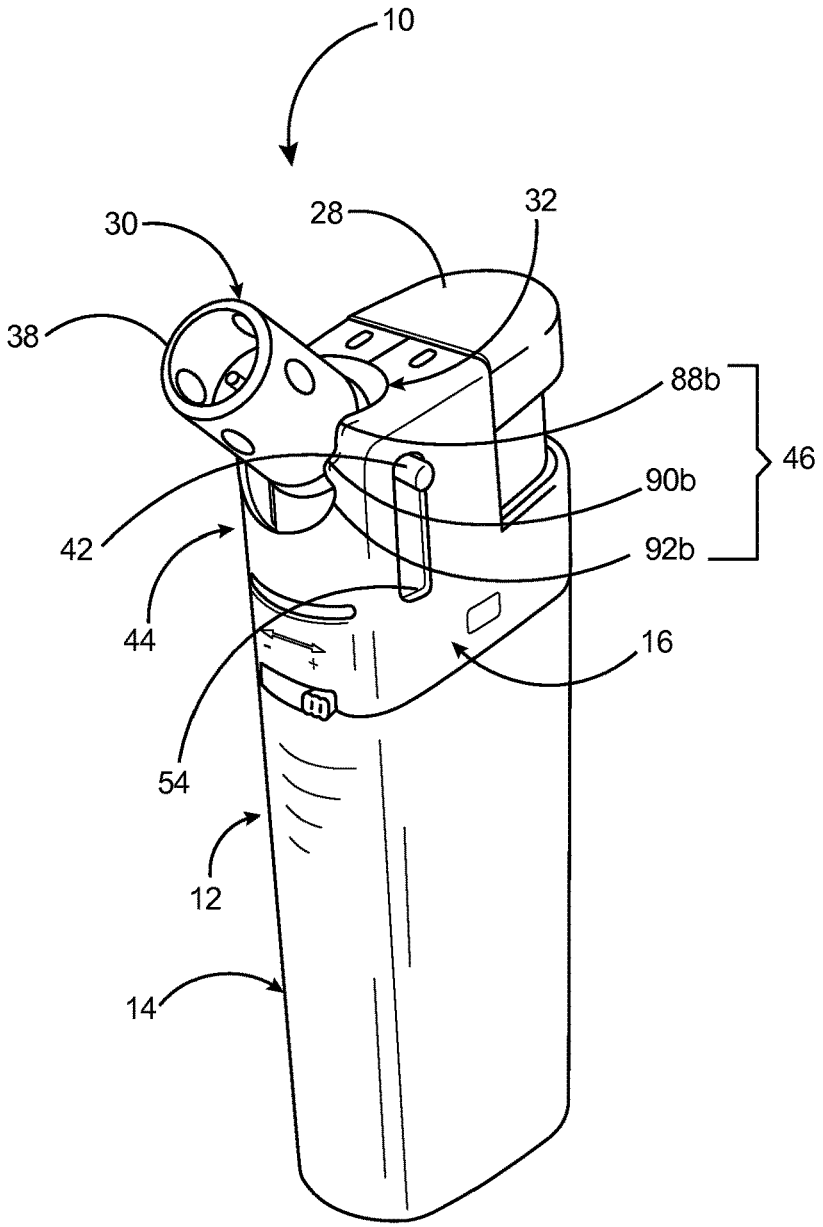
FIG. 1 is a right side perspective view of a portable lighter device having a cylindrical shaped flame directing nozzle in accordance with the present invention.
Figure 2:
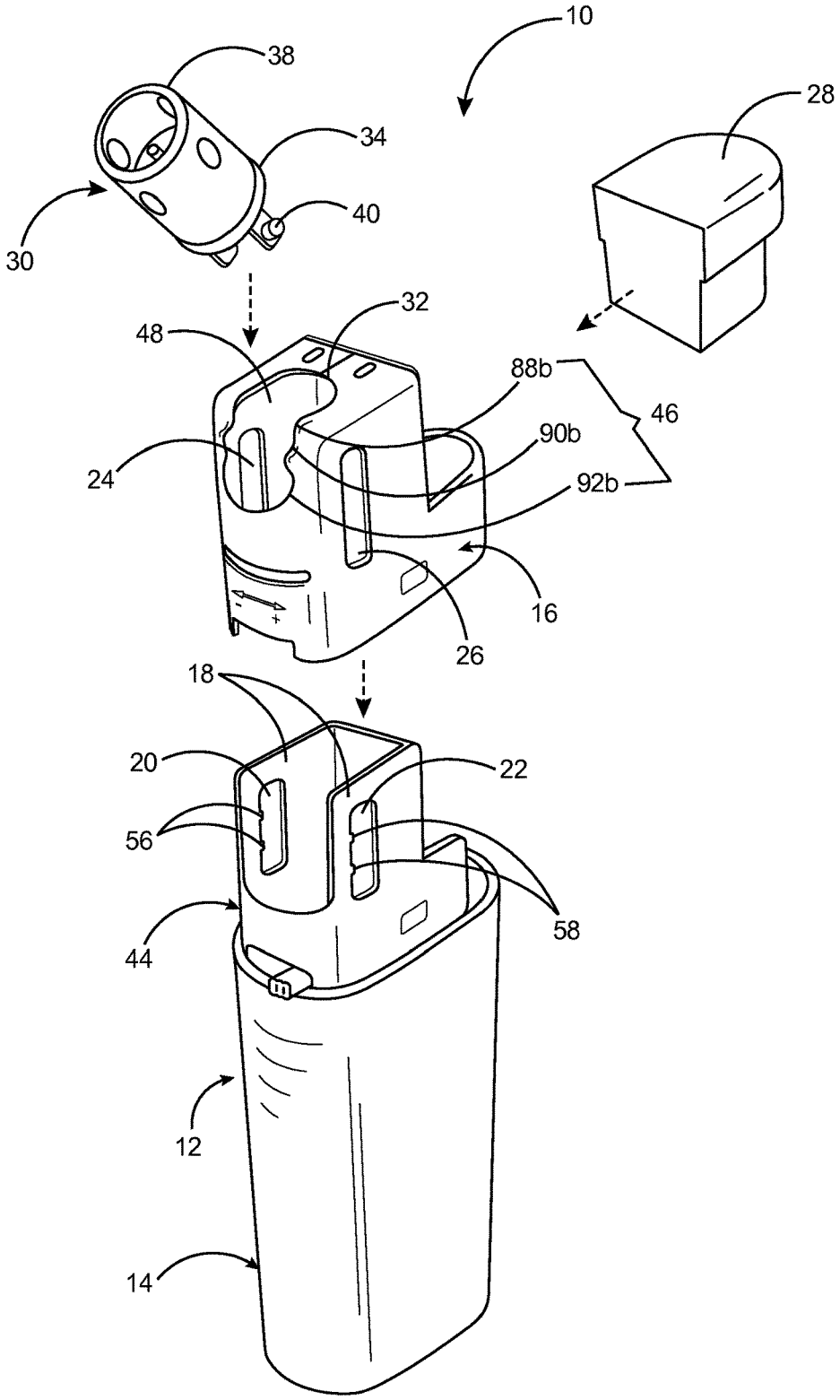
FIG. 2 is an exploded view of the portable lighter device, illustrating a shield member and the flame directing nozzle in accordance with the present invention.

Referring to FIGS. 1-6D of the drawings, a preferred embodiment of a portable lighter device adaptable to move in a plurality of extended and angular positions and in a retracted position according to the present invention is illustrated in different views and generally designated by the reference numeral 10. Referring to FIGS. 1 and 2, the portable lighter device 10 comprises a main body 12 having a first portion 44 and a second portion 14. The first portion 44 includes a pair of arm members 18 (See FIG. 2) having a first arm slot 20 and a second arm slot 22. The first portion 44 is attached to a shield member 16 having a housing 32, a central recess 48 (See FIG. 2), a first shield slot 24 and a second shield slot 26. The shield member 16 is designed to shield the pair of arm members 18. The shielding of the pair of arm members 18 causes the first shield slot 24 to overlap with the first arm slot 20 to create a first slot assembly 52 (See FIG. 5A) and the second shield slot 26 to overlap with the second arm slot 22 to create a second slot assembly 54. The portable lighter device 10 further comprises a cylindrical shaped flame directing nozzle 30 having a base member 34 (See FIG. 2) and a top portion 38. The housing 32 firmly secures the flame directing nozzle 30 within the central recess 48 of the shield member 16. As shown in FIGS. 1 and 2, in the preferred embodiment, the flame directing nozzle 30 is cylindrical shaped and the base member 34 and the top portion 38 are circular shaped. The base member 34 of the nozzle 30 is designed to fit into the central recess 48 and the top portion 38 is open. This causes the heat generated at the nozzle 30 to travel through the top portion 38 and allows the nozzle 30 to cool down faster through convection.

An added advantage of the cylindrical shaped flame directing nozzle 30 is that, in at least one of the plurality of extended positions, the flame directing nozzle 30 can be tilted to the plurality of angular positions according to a user's comfort. The portable lighter device achieves this functionality with the help of at least one groove 46 at the housing 32. This feature allows the user to divert the direction of the flame well away from the user's thumb and fingers thereby preventing the user from getting burnt and leaving it locked down into position and thereby preventing injury to the user overtime of use. In FIG. 1, the flame directing nozzle 30 is tilted to a 45 degree inclination. In the preferred embodiment, the at least one groove 46 includes a first set of grooves 88*a*, 88*b*, a second set of grooves 90*a*, 90*b* and a third set of grooves 92*a*, 92*b*. The housing 32 and the at least one groove 46 make the portable lighter device 10 durable and functional.

As shown in FIG. 1, the second portion 14 of the main body 12 includes a fuel tank (not shown). The fuel tank (not shown) is designed to store an ignition fuel for lighting the portable lighter device 10. The portable lighter device 10 further comprises an ignition button 28 attached to the shield member 16. When the ignition button 28 is pressed, the cylindrical shaped flame directing nozzle 30 emanates flame with the help of the ignition fuel stored in the fuel tank (not shown).

Figure 3:
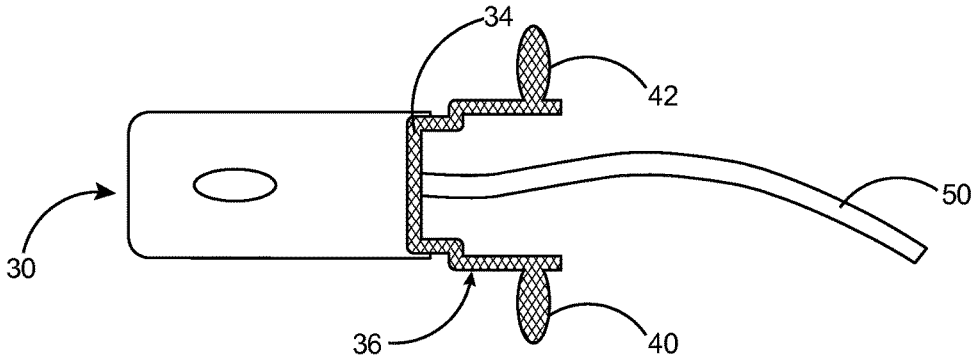
FIG. 3 is a perspective view of a flame directing nozzle attached to a left lug and a right lug of a guide member in accordance with the present invention.

As shown in FIG. 2, the first arm slot 20, the second arm slot 22, the first shield slot 24 and the second shield slot 26 are longitudinally aligned with respect to the main body 12 of the portable lighter device 10. Referring to FIG. 3, the base member 34 is attached to a guide member 36 having a left lug 40 and a right lug 42. The left lug 40 and the right lug 42 are positioned opposite to each other and secure the base member 34 within the central recess 48. The left lug 40 and the right lug 42 are designed to slide through the first slot assembly 52 (See FIG. 5A) and the second slot assembly 54 respectively. The user can easily slide the left lug 40 and the right lug 42 up and down with his thumb. The sliding movement of the left lug 40 and the right lug 42 enables the flame directing nozzle 30 to move in the plurality of extended positions and in the retracted position. When the left lug 40 and the right lug 42 are slid in the upward direction, the flame directing nozzle 30 extends to an upward direction from the central recess 48 and when the left and right lugs 40, 42 are slid in the downward direction, the flame directing nozzle 30 retracts to the central recess 48.

As shown in FIG. 2, the first arm slot 20 includes a plurality of first projections 56 and the second arm slot 22 includes a plurality of second projections 58. The sliding movement of the first lug 40 and the second lug 42 in the upward and downward direction enables the nozzle 30 to attain the extended position and the retracted position respectively. When the user wants the nozzle 30 to be extended in an upright position, then the left lug 40 and the right lug 42 are slid in the upward direction using the thumb. The plurality of first projections 56 and the plurality of second projections 58 keep the left and right lugs 40, 42 in the upward position without falling down, as well as act to lock and secure the nozzle over time into position at 90 degrees or other angles.

As shown in FIG. 3, the left lug 40 and the right lug 42 possess enough length to extend marginally past outside of the shield member 16 such that the user can easily press the left lug 40 and the right lug 42 with his thumb. In the retracted position, the flame directing nozzle 30 is substantially enclosed within the central recess 48. The left lug 40 and the right lug 42 avoid the need for directly touching the hot nozzle 30 directly with the user's thumb when the user wishes to change from the inclined position of the nozzle 30 to the retracted position. In the retracted position, the flame directing nozzle 30 rests within the central recess 48. In order to attain this position, the left lug 40 and the right lug 42 are slid in the downward direction. The portable lighter device 10 includes a fuel liner 50 through which the ignition fuel passes through the flame directing nozzle 30.

Figure 4A:
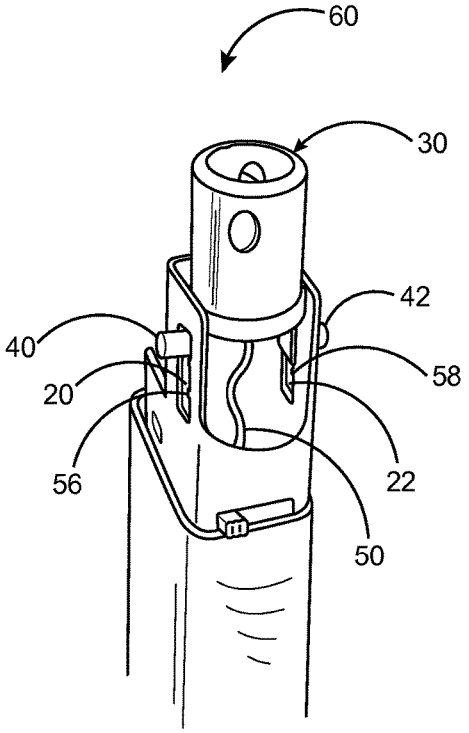
FIG. 4A is a left side perspective view of the portable lighter device, illustrating a plurality of first projections, a plurality of second projections and the flame directing nozzle positioned in a zero degree inclination in accordance with the present invention.

FIGS. 4A through 4D clearly illustrate the plurality of first projections 56 and the plurality of second projections 58 at the first arm slot 20 and the second arm slot 22 respectively. Through the FIGS. 4A-4D, the portable lighter device 10 is shown without the shield member 16. As shown in FIG. 4A, the flame directing nozzle 30 will be at an inclination of zero degree when the flame directing nozzle 30 is initially extended from the retracted position. The left lug 40 and the right lug 42 are slid in the upward direction. The first set of grooves 88*a*, 88*b* helps the nozzle 30 to accommodate in this upright position without pivoting out of the central recess 48.

Figure 4B:
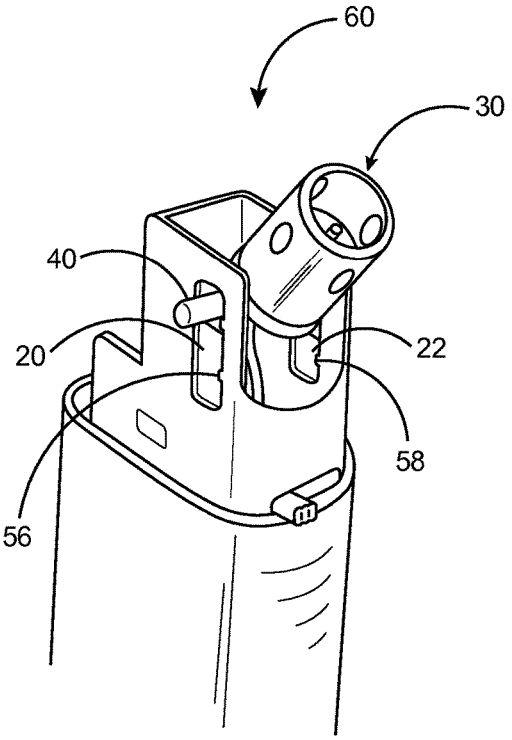
FIG. 4B is a left side perspective view of the portable lighter device, illustrating the plurality of first projections, the plurality of second projections and the flame directing nozzle positioned in a 45 degree inclination in accordance with the present invention.
Figure 4C:
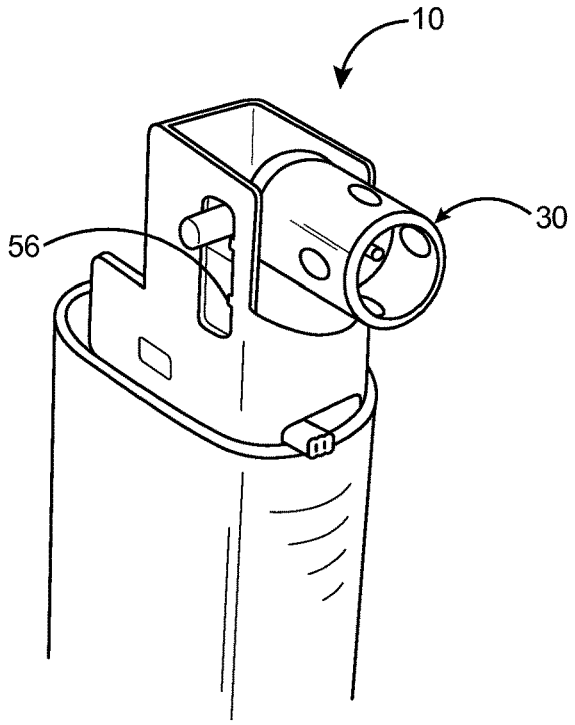
FIG. 4C is a left side perspective view of the portable lighter device, illustrating the plurality of first projections, the plurality of second projections and the flame directing nozzle positioned in a 90 degree inclination in accordance with the present invention.
Figure 4D:
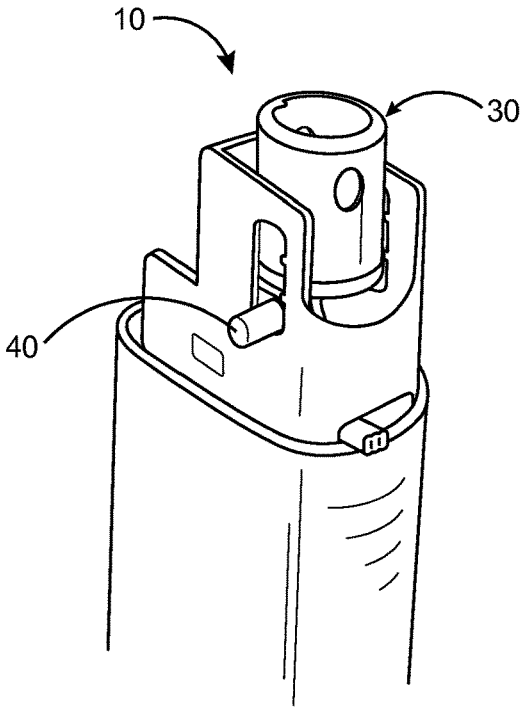
FIG. 4D is a left side perspective view of the portable lighter device, illustrating the flame directing nozzle positioned in a retracted position in accordance with the present invention.

Referring to FIG. 4B, the flame directing nozzle 30 is positioned in the 45 degree inclination. The second set of grooves 90*a*, 90*b* helps to accommodate the nozzle 30 within the central recess 48 in a 45 degree inclination. Referring to FIG. 4C, the flame directing nozzle 30 is positioned in the 90 degree inclination. In order to attain this inclination, the user tilts the nozzle to 90 degree with his thumb. The third set of grooves 92*a*, 92*b* helps to accommodate the cylindrical shaped nozzle 30 within the housing while tilting towards 90 degree inclination. Referring to FIG. 4D, the flame directing nozzle 30 is in the retracted position. The left and the right lugs 40, 42 are completely slid down to retract the nozzle 30 within the central recess 48.

FIGS. 5A through 5D show left side views of the flame directing nozzle 30 and the shield member 16. The curvature of first set of grooves 88*a*, 88*b*, the second set of grooves 90*a*, 90*b* and the third set of grooves 92*a*, 92*b*, mimics the curvature of the flame directing nozzle 30 and as such securely accommodates nozzle 30 within the housing 32.

Figure 5A:
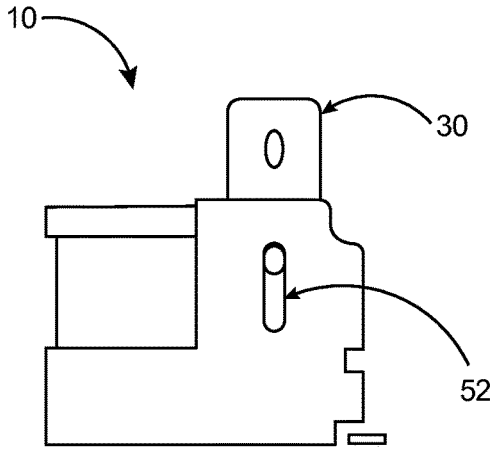
FIG. 5A is a left side view of the shield member and the flame directing nozzle positioned in the zero degree inclination in accordance with the present invention.
Figure 5B:
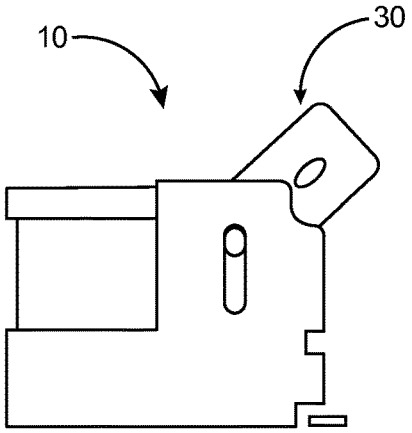
FIG. 5B is a left side view of the shield member and the flame directing nozzle positioned in the 45 degree inclination in accordance with the present invention.
Figure 5C:
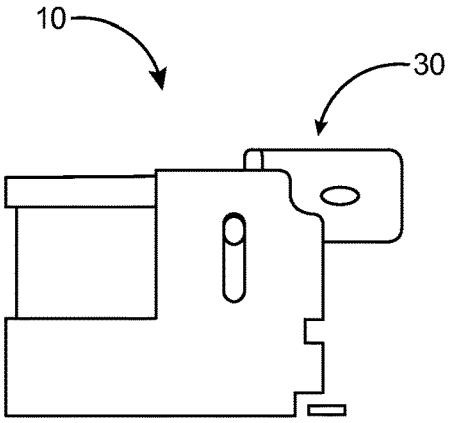
FIG. 5C is a left side view of the shield member and the flame directing nozzle positioned in the 90 degree inclination in accordance with the present invention.
Figure 5D:
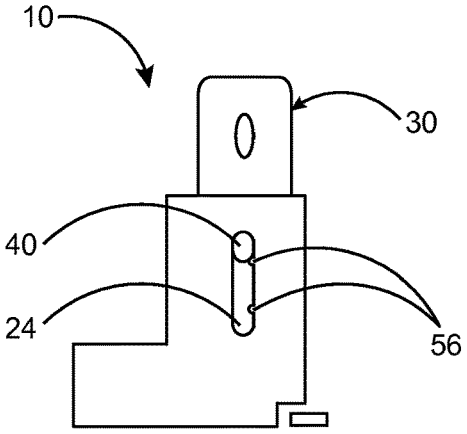
FIG. 5D is a left side view of a first shield slot, the shield member and the flame directing nozzle positioned in the zero degree inclination in accordance with the present invention.

Referring to FIG. 5A, the flame directing nozzle 30 is at an inclination of zero degree. As shown in FIG. 5B, the flame directing nozzle 30 is positioned at an inclination of 45 degree. Next, if the user wishes to tilt the flame directing nozzle 30 to the 90 degree inclination as shown in FIG. 5C, the user tilts the flame directing nozzle 30 to 90 degree with his thumb. FIG. 5D is a left side view of the portable lighter device 10 illustrating the first shield slot 24, the shield member 16 and the flame directing nozzle 30. The flame directing nozzle 30 is positioned in the zero degree inclination. The left lug 40 and the right lug 42 are pressed in the upward direction to achieve this position. The plurality of first projections 56 and the plurality of second projections 58 firmly hold the left and the right lugs 40, 42 without slipping. The at least one groove 46 provides a frictional force to the housing 32 that allows the flame directing nozzle 30 to stay locked down while moving in the plurality of angular positions. The at least one groove 46 prevents the housing from wear and tear between the first and the second lugs 40, 42 and the first and second arm slots 20, 22 thereby making the portable lighter device 10 safer as the nozzle 30 does not move during ignition.

Figure 6A:
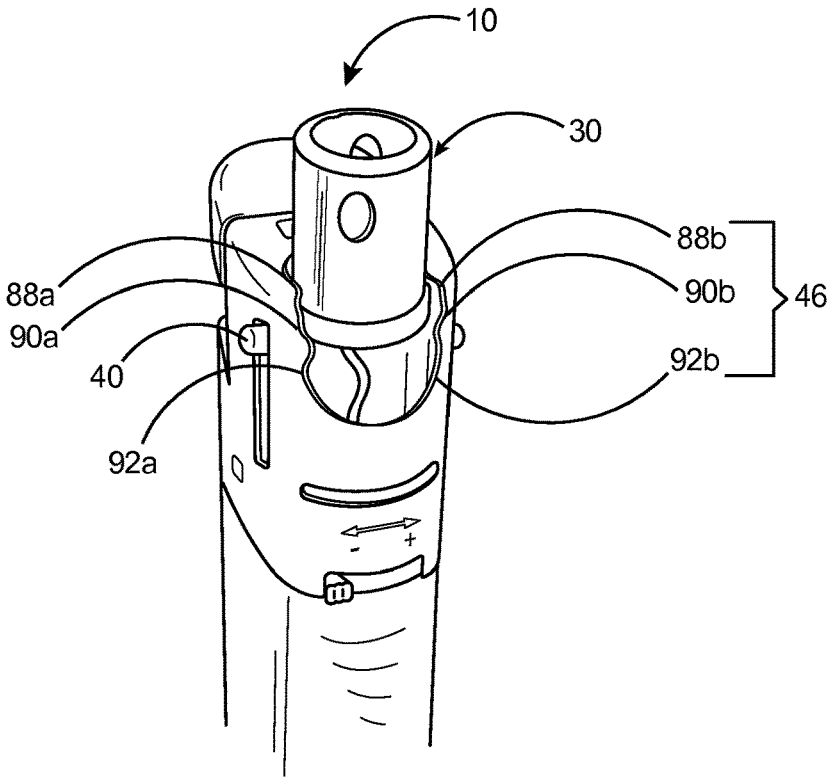
FIG. 6A is a left side perspective view of the portable lighter device, illustrating the flame directing nozzle positioned in a zero degree inclination, the shield member and at least one groove.
Figure 6B:
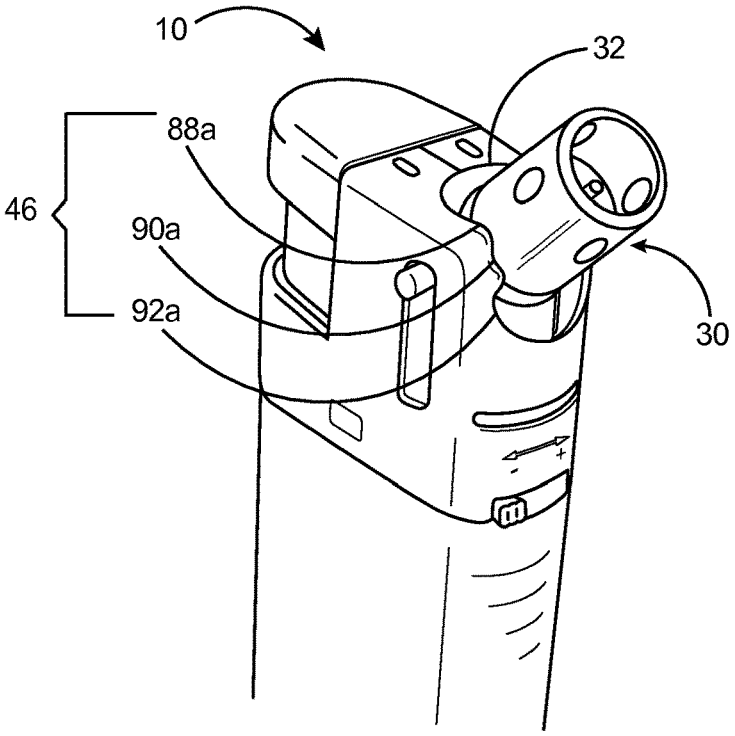
FIG. 6B is a left side perspective view of the portable lighter device shown in FIG. 6A of the present invention, illustrating the flame directing nozzle positioned in a 45 degree inclination, the shield member and the at least one groove.
Figure 6C:
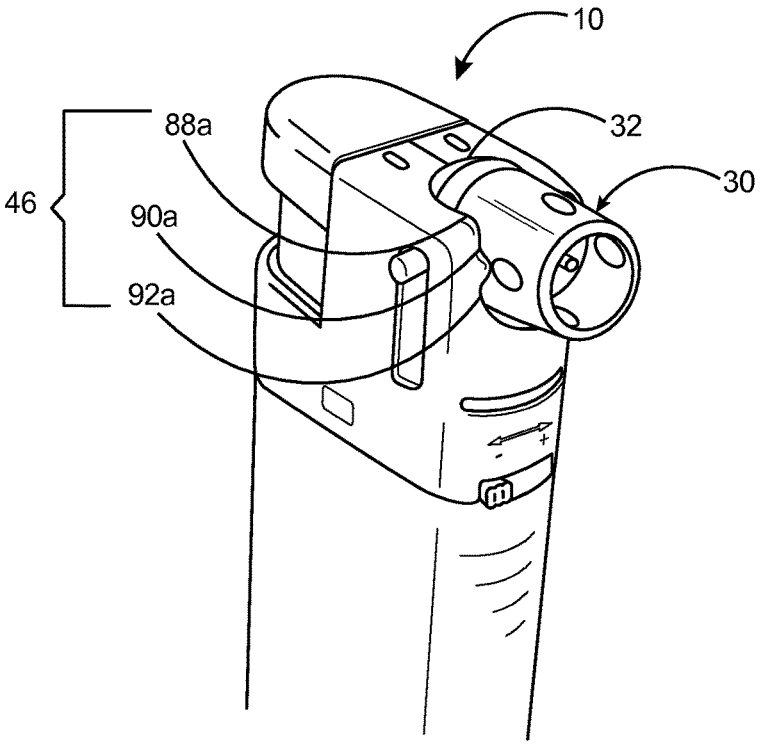
FIG. 6C is a left side perspective view of the portable lighter device shown in FIG. 6A of the present invention, illustrating the flame directing nozzle positioned in a 90 degree inclination, the shield member and the at least one groove.
Figure 6D:
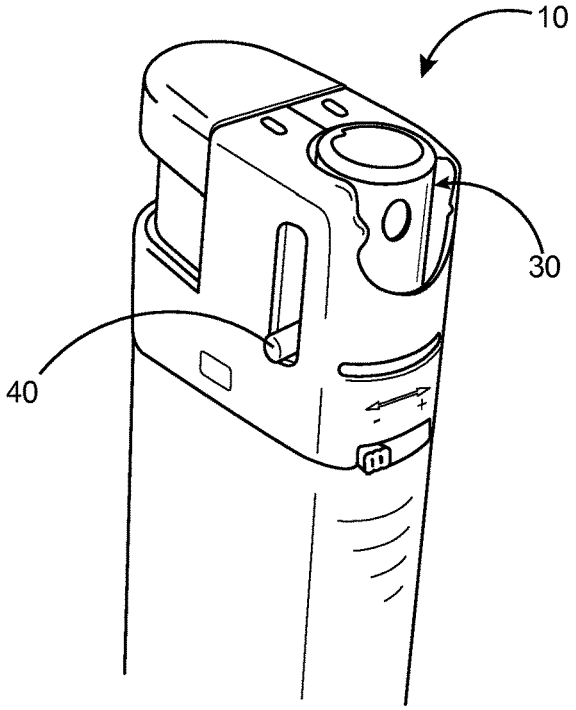
FIG. 6D is a left side perspective view of the portable lighter device shown in FIG. 6A of the present invention, illustrating the flame directing nozzle in a retracted position, the shield member and the at least one groove.

FIG. 6A shows the flame directing nozzle 30 in a zero degree inclination. In order to attain this position, a left lug 40 and a right lug 42 are pressed in the upward direction. If the user likes to tilt the flame directing nozzle 30 to an inclination of 45 degrees, then the flame directing nozzle 30 is tilted as depicted in FIG. 6B utilizing the user's thumb. In FIG. 6C, the flame directing nozzle 30 is tilted to a 90 degree inclination. The user easily achieves this angular position by tilting the flame directing nozzle 30 to an inclination of 90 degree with his thumb. FIG. 6D shows the flame directing nozzle 30 positioned in the retracted position. The flame directing nozzle 30 is turned to this retracted position when the portable lighter device 10 is not in use. In order to attain this position, the left lug 40 and the right lug 42 are pressed in the downward direction. The cylindrical shaped flame directing nozzle 30 has significant surface contact between the at least one groove 46 and the housing 32 and thereby contributes to increased heat loss away from the nozzle through conduction. The flame directing nozzle 30 will be less hot and thereby reduces the possibilities to get the user's thumb burnt while in use.

Figure 7A:
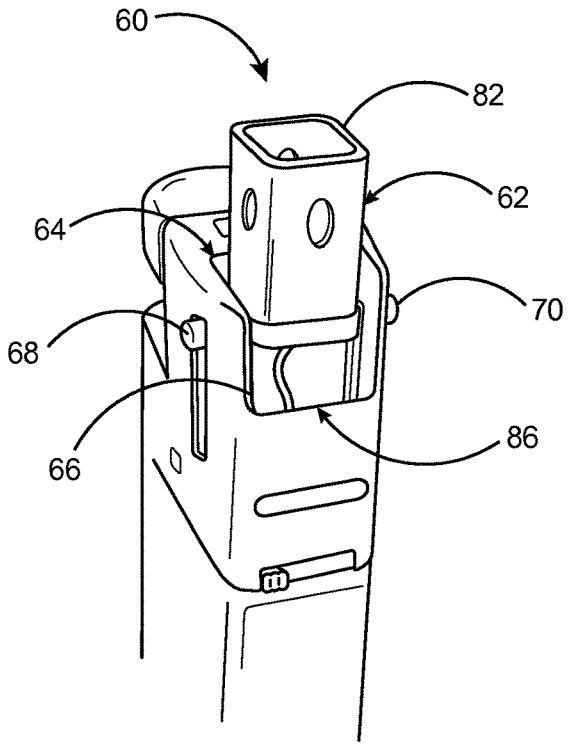
FIG. 7A is a left side perspective view of another embodiment of the present invention, illustrating a square shaped flame directing nozzle of a portable lighter device positioned in a zero degree inclination.

FIGS. 7A through 7E clearly depict another embodiment of the portable lighter device 10 illustrated in FIG. 1. Referring to FIG. 7A, a portable lighter device 60 having a square shaped flame directing nozzle 62 is illustrated. The portable lighter device 60 includes a housing 64. Preferably, at least three sides of the flame directing nozzle 62 are surrounded by the housing 64. The housing 64 includes at least one groove 66 that allows the flame directing nozzle 62 to tilt in various inclined positions. The portable lighter device 60 further includes a shield member 86 having a central recess 84 (See FIG. 7B). The square shaped flame directing nozzle 62 includes a base member 80 and a top portion 82. Both the base member 80 and the top portion 82 are square shaped.

Figure 7B:
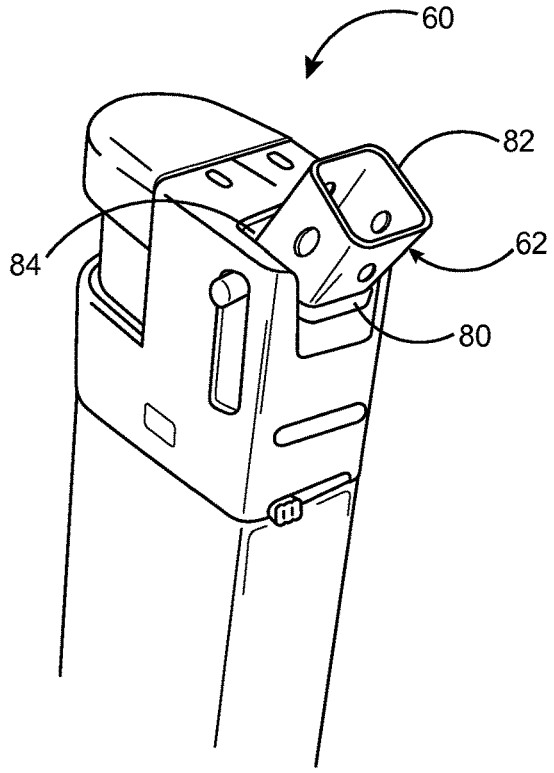
FIG. 7B is a left side perspective view of the portable lighter device shown in FIG. 7A of the present invention, illustrating the square flame directing nozzle positioned in a 45 degree inclination.
Figure 7C:
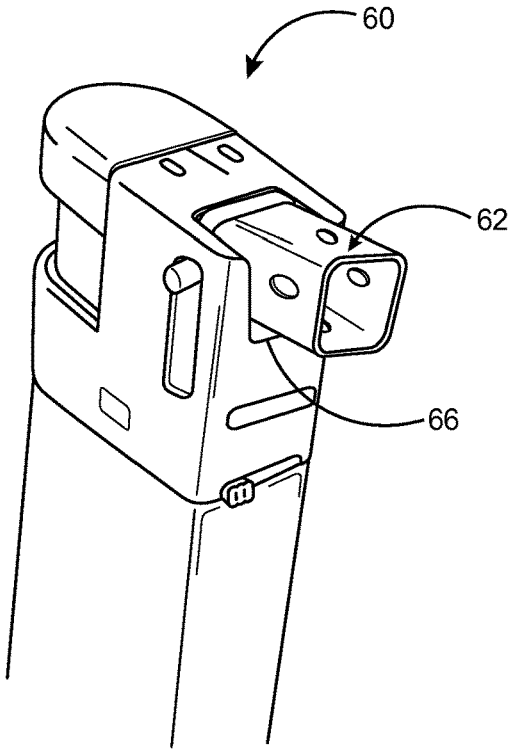
FIG. 7C is a left side perspective view of the portable lighter device shown in FIG. 7A of the present invention, illustrating the square flame directing nozzle positioned in a 90 degree inclination.
Figure 7D:
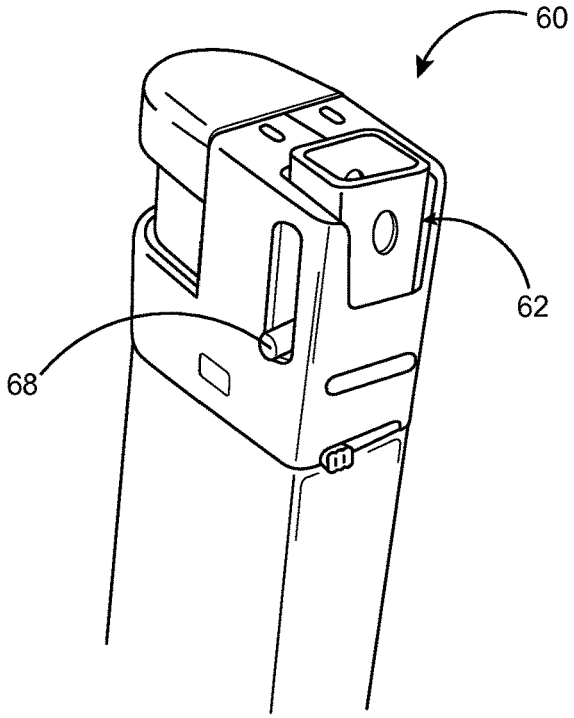
FIG. 7D is a left side perspective view of the portable lighter device shown in FIG. 7A of the present invention, illustrating the square flame directing nozzle in a retracted position.

As shown in FIG. 7A, the flame directing nozzle 62 is in a zero degree inclination. In order to attain this position, a left lug 68 and a right lug 70 are pressed in the upward direction. If the user likes to tilt the flame directing nozzle 62 to an inclination of 45 degrees, then the flame directing nozzle 62 is tilted as depicted in FIG. 7B utilizing the user's thumb. In FIG. 7C, the flame directing nozzle 62 is tilted to a 90 degree inclination. The user easily achieves this angular position by tilting the flame directing nozzle 62 to an inclination of 90 degree with his thumb. FIG. 7D shows the flame directing nozzle 62 positioned in the retracted position. The flame directing nozzle 62 is turned to this retracted position when the portable lighter device 60 is not in use. In order to attain this position, the left lug 68 and the right lug 70 (See FIG. 7A) are pressed in the downward direction.

Figure 7E:
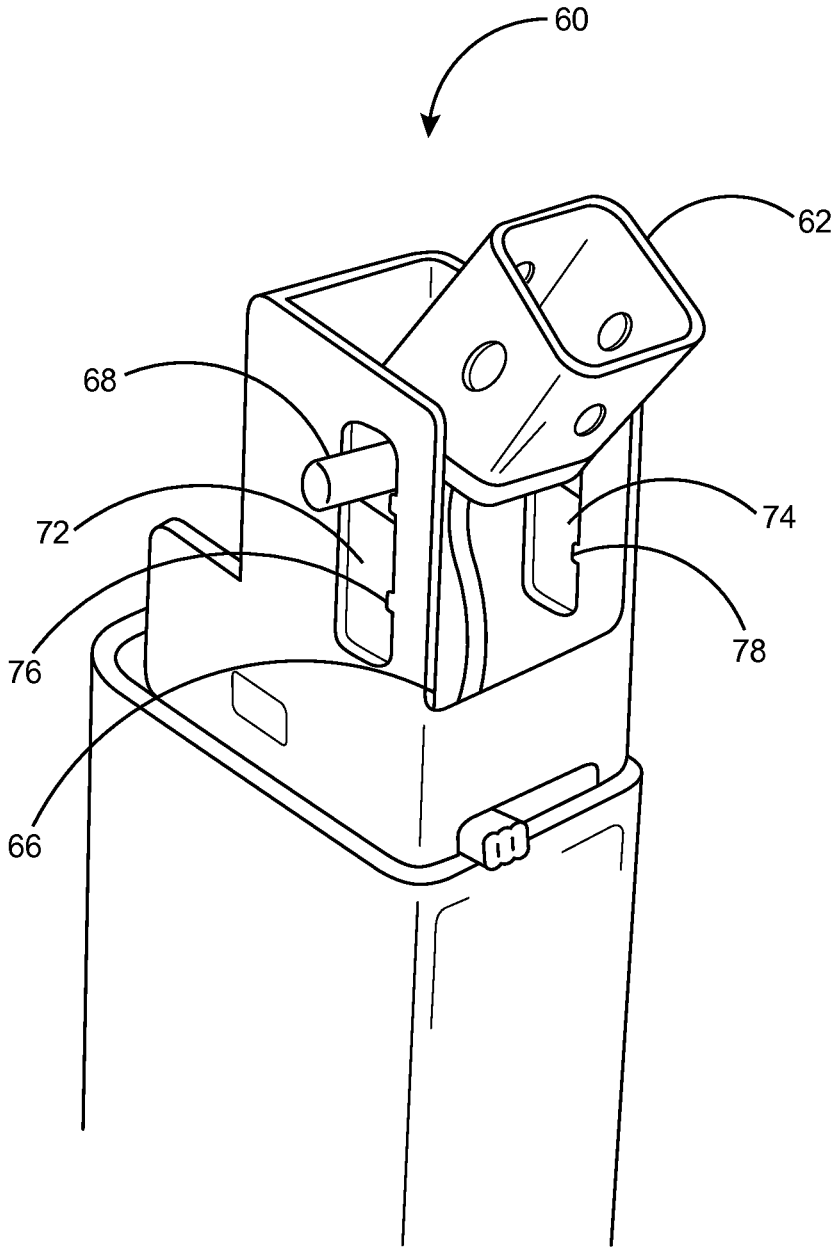
FIG. 7E is a left side perspective view of the portable lighter device shown in FIG. 7A, illustrating a plurality of first projections at a first arm slot in accordance with the present invention.

FIG. 7E is a left side perspective view of the portable lighter device 60 shown in FIG. 7A, illustrating a plurality of first projections 76 at a first arm slot 72 and a plurality of second projections 78 at a second arm slot 74. The square shaped nozzle 62 is in a 45 degree inclination. The user easily achieves different angular movements by tilting the flame directing nozzle 62 with his thumb. The square bottom groove 66 helps to accommodate the nozzle 62 within the housing without slipping.

While a particular form of the invention has been illustrated and described, it will be apparent that various modifications can be made without departing from the spirit and scope of the invention For example, components of the portable lighter device 10 can be varied in size, materials, shape, configuration, function and assembly in accordance with the intended use. In addition, the flame directing nozzle 30 can be tilted to various inclinations. Accordingly, it is not intended that the invention be limited, except as by the appended claims.

What is claimed is:

1. A portable lighter device comprising:

a main body having a first portion and a second portion;

a pair of arm members attached to the first portion, the pair of arm members includes a first arm slot and a second arm slot, the first arm slot includes a plurality of first projections and the second arm slot includes a plurality of second projections;

a shield member attached to the first portion, the shield member includes a first shield slot, a second shield slot, a central recess and a housing having at least one groove with a first curvature, the shield member being positioned over the pair of arm members to create a first slot assembly and a second slot assembly;

a flame directing nozzle with a second curvature and having a base member, the flame directing nozzle being positioned within the central recess and secured by the housing;

an ignition button attached to the shield member; and a guide member attached to the base member, the guide member includes a left lug and a right lug, the left lug and the right lug being designed to slide through the first slot assembly and the second slot assembly respectively, the sliding movement of the left and right lugs enables the flame directing nozzle to move in a plurality of extended positions and in a retracted position, wherein the plurality of first projections and the plurality of second projections firmly hold the first lug and the second lug respectively without falling, when the flame directing nozzle being moved in at least one of the plurality of extended positions, the flame directing nozzle tilts in a plurality of angular positions, the at least one groove comfortably accommodates the flame directing nozzle within the housing while the nozzle tilts in at least one of the plurality of angular positions;

wherein the first curvature mimics the second curvature; and whereby the at least one groove, the left and the right lugs and the first and the second projections enable the flame directing nozzle to attain the plurality of angular positions according to a user's desire.

2. The portable lighter device of claim 1 wherein the shield member is designed to shield the pair of arm members.

3. The portable lighter device of claim 1 wherein shielding of the pair of arm members by the shield member causes the first shield slot to overlap with the first arm slot to create the first slot assembly and the second shield slot to overlap with the second arm slot to create the second slot assembly.

4. The portable lighter device of claim 1 wherein the second portion includes a fuel tank designed to store an ignition fuel for lighting the portable lighter device.

5. The portable lighter device of claim 1 wherein the ignition button is activated to emanate flame from the flame directing nozzle utilizing the ignition fuel.

6. The portable lighter device of claim 1 wherein the flame directing nozzle includes a top portion.

7. The portable lighter device of claim 1 wherein tilting of the flame directing nozzle to the plurality of angular positions allows the user to divert the direction of the flame emanated from the flame directing nozzle well away from the user's thumb and fingers thereby preventing injury to the user.

8. The portable lighter device of claim 1 wherein the left and right lugs are positioned opposite to each other for securing the base member within the central recess.

9. A portable lighter device comprising:

a main body having a first portion and a second portion, the second portion includes a fuel tank;

a pair of arm members attached to the first portion, the pair of arm members includes a first arm slot and a second arm slot, the first arm slot includes a plurality of first projections and the second arm slot includes a plurality of second projections;

a shield member attached to the first portion and being designed to shield the pair of arm members, the shield member includes a first shield slot, a second shield slot, a central recess and a housing having at least one groove with a first curvature, the shield member being positioned over the pair of arm members to create a first slot assembly and a second slot assembly;

a flame directing nozzle with a second curvature and having a base member and a top portion, the flame directing nozzle being positioned within the central recess and secured by the housing;

an ignition button attached to the shield member; and a guide member attached to the base member, the guide member includes a left lug and a right lug, the left lug and the right lug being designed to slide through the first slot assembly and the second slot assembly respectively, the sliding movement of the left and right lugs enables the flame directing nozzle to move in a plurality of extended positions and in a retracted position, wherein the plurality of first projections and the plurality of second projections firmly hold the first lug and the second lug respectively without falling;

wherein the first curvature mimics the second curvature; and whereby the flame directing nozzle being designed to tilt in a plurality of angular positions when the flame directing nozzle being moved in at least one of the plurality of extended positions, the at least one groove comfortably accommodates the flame directing nozzle within the housing while the nozzle got tilted in at least one of the plurality of angular positions.

10. The portable lighter device of claim 9 wherein the first shield slot overlaps with the first arm slot to create a first slot assembly and the second shield slot overlaps with the second arm slot to create a second slot assembly.

11. The portable lighter device of claim 9 wherein the fuel tank is designed to store an ignition fuel for lighting the portable lighter device.

12. The portable lighter device of claim 9 wherein the ignition button is activated to emanate flame from the flame directing nozzle utilizing the ignition fuel.

13. The portable lighter device of claim 9 wherein the left lug and the right lug are positioned opposite to each other for securing the base member within the central recess.

14. A retractable and extendable portable lighter device comprising:

a main body having a first portion and a second portion, the second portion includes a fuel tank;

a pair of arm members attached to the first portion, the pair of arm members includes a first arm slot and a second arm slot, the first arm slot includes a plurality of first projections and the second arm slot includes a plurality of second projections;

a shield member attached to the first portion and being designed to shield the pair of arm members, the shield member includes a first shield slot, a second shield slot, a central recess and a housing having at least one groove with a first curvature, the first shield slot overlaps with the first arm slot to create a first slot assembly and the second shield slot overlaps with the second arm slot to create a second slot assembly;

a flame directing nozzle having a second curvature and a base member and a top portion, the flame directing nozzle being positioned within the central recess and secured by the housing;

an ignition button attached to the shield member, the ignition button being activated to emanate flame from the flame directing nozzle; and a guide member attached to the base member, the guide member includes a left lug and a right lug, the left lug and the right lug being designed to slide through the first slot assembly and the second slot assembly respectively, the sliding movement of the left and right lugs enables the flame directing nozzle to move in a plurality of extended positions and in a retracted position, wherein the plurality of first projections and the plurality of second projections firmly hold the first lug and the second lug respectively without falling;

wherein the first curvature mimics the second curvature; and whereby the flame directing nozzle being designed to attain a plurality of angular positions when the flame directing nozzle being moved in at least one of the plurality of extended positions and the at least one groove comfortably accommodates the flame directing nozzle within the housing while the nozzle got tilted in at least one of the plurality of angular positions.

15. The retractable and extendable portable lighter device of claim 14 wherein the fuel tank is designed to store an ignition fuel for lighting the portable lighter device.

16. The retractable and extendable portable lighter device of claim 14 wherein the ignition button is activated to emanate flame from the flame directing nozzle utilizing the ignition fuel.

17. The retractable and extendable portable lighter device of claim 14 wherein movement of the flame directing nozzle to the plurality of angular positions allows the user to divert the direction of the flame emanated from the flame directing nozzle well away from the user's thumb and fingers thereby preventing injury to the user.

18. The portable lighter device of claim 1 wherein the first curvature and the second curvature provide surface contact area between the housing and the flame directing nozzle used to remove the heat from the flame directing nozzle via conduction.

19. The portable lighter device of claim 9 wherein the first curvature and the second curvature provide surface contact area between the housing and the flame directing nozzle used to remove the heat from the flame directing nozzle via conduction.

20. The portable lighter device of claim 1 wherein the first curvature is configured with the open edge of the central recess.

* * * * *